United States Patent [19]

Remy

[11] 4,450,826

[45] May 29, 1984

[54] TOOL FOR TRUING UP GRINDING WHEELS

[75] Inventor: Jean-Claude Remy, Le Locle, Switzerland

[73] Assignee: Dixi S.A. Usine 4, Le Locle, Switzerland

[21] Appl. No.: 322,470

[22] Filed: Nov. 18, 1981

[30] Foreign Application Priority Data

Jun. 2, 1981 [CH] Switzerland ..... 3595/81

[51] Int. Cl.[3] ..... B24B 53/12

[52] U.S. Cl. ..... 125/11 N; 408/714; 125/39

[58] Field of Search ..... 125/39, 11 R, 11 N; 408/714; 29/568

[56] References Cited

U.S. PATENT DOCUMENTS

| | | | |
|---|---|---|---|
| 1,393,667 | 10/1921 | Crampton | 125/11 R |
| 1,776,335 | 9/1930 | Rauzieres | 125/39 |
| 2,127,998 | 8/1938 | Jearum | 125/39 |
| 2,501,374 | 3/1950 | Blee | 125/39 |
| 2,581,609 | 1/1952 | Small | 125/39 |
| 2,664,875 | 1/1954 | Koch | 125/11 R |
| 2,791,211 | 5/1957 | Nagy | 125/11 N |

*Primary Examiner*—Harold D. Whitehead

*Attorney, Agent, or Firm*—Robert E. Burns; Emmanuel J. Lobato; Bruce L. Adams

[57] ABSTRACT

A holder to which a machining insert for example of triangular configuration is secured; this insert comprises a pivot pin, is clamped by means of a jaw and positioned angularly by a slider having a forked end portion urged against one side of the insert by spring means. The clamping screw constitutes a stop member to the slider.

8 Claims, 3 Drawing Figures

TOOL FOR TRUING UP GRINDING WHEELS

BACKGROUND OF THE INVENTION

This invention relates to a tool for truing up grinding wheels, which comprises a flat insert of regular polygonal configuration consisting at least partially of hard or diamond-containing metal having a plurality of cutting edges and secured to the tool holder on the one hand by pivot means having its axis coincident with the plate axis and on the other hand by clamping means for preventing the insert from rotating.

THE PRIOR ART

It is a widely spread practice to use cutting tools operating according to the conventional chip cutting technique, which comprise an insert of triangular or circular-segment configuration provided with a pivot pin projecting from its bearing surface, this insert being secured by clamping in the desired position. It is also known to use inserts of regular polygonal shape, notably triangular inserts having several cutting edges so that these can be used successively. The change from one cutting edge to another is advantageously obtained by simply rotating the insert about its pivot means, without removing the insert from the holder.

When it is desired to use a tool of this type for truing up a grinding wheel (i.e. in a grinder cutting operation), notably in the case of a grinding wheel for precision grinding machines, the insert must be set in a predetermined, unchanging angular position. Therefore, the insert must be positioned, notably when changing from one cutting edge to the next cutting edge, by means of a tool, before definitively fixing the insert by clamping or tightening same. Now this preliminary positioning operation is particularly tedious and ackward, considering the small size of the inserts implemented.

SUMMARY OF THE INVENTION

It is the essential object of the present invention to dispense with this positioning step.

For this purpose, the tool according to the present invention is characterized in that the tool holder further comprises means for automatically positioning the insert in proper angular relationship, said means consisting of a slider or like member adapted to slide axially in the holder and of a spring engaging said slider so as to urge same resiliently against at least one side of the insert.

The resiliency thus imparted to the slider is such that the latter can be slightly retracted to permit the positioning of the insert in its holder and subsequently its rotation about its pivot means for switching from one cutting position or edge to another. Releasing the spring-loaded slider will restore the insert automatically to the proper angular position.

DESRIPTION OF THE PREFERRED EMBODIMENT

Figure 1:
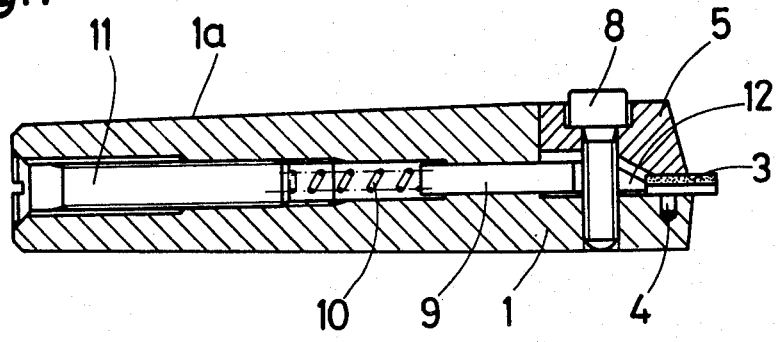
FIG. 1 is an axial longitudinal secton showing the component elements of a tool.
Figure 2:
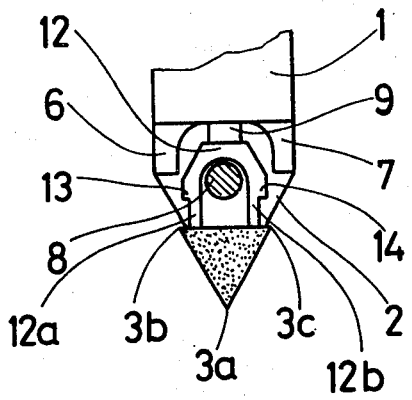
FIG. 2 is a plane view from above showing the insert supporting end of the tool, without the insert holding jaw.
Figure 3:
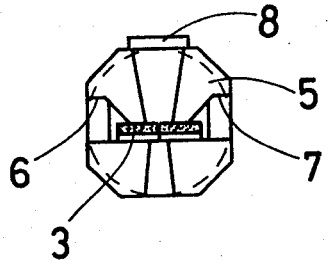
FIG. 3 illustrates a front view of the same tool.

The tool illustrated in the drawing comprises a body 1 provided in this specific form of embodiment with an external Morse taper, though other shapes, notably the cylindrical shape, may be contemplated, if desired. This body 1 has a flat bearing surface 2 intended for a chip-removing insert 3 of equilateral triangular shape, having three cutting edges 3*a*, 3*b*, 3*c*. It consists for example, in the known fashion, of a top plate of sintered diamond powder adhering to a tungsten carbide base provided with a pivot pin 4 adapted to fit in a cylindrical hole of the supporting body 1. The pivot axis defined by the pivot pen 4 is perpendicular to the bearing surface 2 and is coincident with the center of the insert to permit all of the cutting edges to be used alternatively. The insert 3, held in position on face 2 by a jaw 5 bearing against two lateral faces 6 and 7, is clamped by means of a screw 8.

An axial passage is formed through the body 1 in which a slider 9 is urged toward the operating end of the tool by a coil compression spring 10 disposed between the slider 9 and a rear screw 11 engaging a tapped portion of said axial passage. The front end of slider 9 is fork shaped as shown at 12, the two prongs 12*a* and 12*b* of this fork 12 engaging one side of the triangular insert 3, in the vicinity of the adjacent two vertices of said insert 3. When no insert is present the central hollow of fork 12 abutes the screw 8 which will thus act as a stop member. This fork 12 further comprises a pair of shoulders 13, 14 engageable by a tool so that the slider 9 can be pushed back to permit the positioning or rotation of the insert 3.

To fit an insert in proper position in the holder the clamp 5 is cleared sufficiently, however without removing the screw 8. To switch from one cutting edge to another, it is only necessary to release the clamp 5.

When the fork 12 is released, it will position automatically and angularly the insert 3 in a predetermined position. Then, it is only necessary to retighten the clamp 5.

Of course, the device of the present invention should not be construed as being limited by a fork-shaped tool end, or by a triangular insert. In fact, the insert may have any desired and suitable regular polygonal configuration. Thus, it is possible to use a square insert engaging a dihedral notch formed at the operative end of the positioning slider. Moreover, the insert pivot pin 4 may if desired by driven or cemented into a hole formed through the insert, or alternatively the same pivot pin may be formed integrally with the tool holder and engage a perforated insert.

What is claimed is:

1. A tool for truing-up grinding wheels comprising an elongate body having at one end a bearing surface for supporting an insert, an insert of regular polygonal configuration made at least partially of very hard material and having a plurality of cutting edges supported on said bearing surface, pivot means perpendicular to said bearing surface and coincident with the center of said insert about which said insert is rotatable to bring one or another of said cutting edges into an operative position, means for clamping said insert against said bearing surface and means for automatically positioning said insert angularly, said positioning means comprising an element slidable axially of said body and spring means for urging said slidable element axially into engagement with said insert, said slidable element having edge surfaces engageable with said insert to position said insert angularly with one cutting edge in operative postion, and being retractable against the force of the spring to permit turning said insert to a new position.

2. A tool according to claim 1, in which said insert is triangular and in which said sliding element has spaced contact surfaces engageable with a flat side of said insert to position an opposite apex of said insert in operative position.

3. A tool according to claim 2, in which said clamping means comprises a clamping jaw and a screw-passing through an opening in said jaw and screwed into a tapped hole in said body, said sliding element straddling said screw.

4. A tool according to claim 3, in which said screw is engageable with said sliding element to limit movement of said sliding element and thereby retain said sliding element in said body when no insert is present.

5. A tool according to claim 1, in which means is provided for retracting said sliding element to permit rotation of said insert to a new position.

6. A tool according to claim 5, in which said retracting means comprises at least one shoulder on said sliding element engageable by an instrumentality to retract said sliding element.

7. A tool according to claim 1, in which said elongate body has an axial bore, said sliding element being slidable in said bore and said spring means comprising a coil spring in said bore and having an end acting on said slidable element to move it axially toward said insert.

8. A tool according to claim 7, further comprising a rear screw screwed into said axial bore from the end of said elongate body opposite said bearing surface and retaining said spring and sliding element in said bore.

* * * * *